United States Patent [19]

Lamb

[11] 4,181,046

[45] Jan. 1, 1980

[54] HAND-HELD CANVAS STRETCHING APPARATUS

[76] Inventor: Terrence R. Lamb, 3549 S. St. N.W., Washington, D.C. 20007

[21] Appl. No.: 887,376

[22] Filed: Mar. 16, 1978

[51] Int. Cl.[2] ..... B25B 7/00; B66F 3/00

[52] U.S. Cl. ..... 81/5.1 R; 259/77; 140/123.5

[58] Field of Search ..... 81/3 J, 5.1 R, 381–383; 254/77, 79, 80; 140/108, 121, 123.5; 73/141 HB, 143

[56] References Cited

U.S. PATENT DOCUMENTS

| | | | |
|---|---|---|---|
| 148,347 | 3/1974 | Boller | 254/77 |
| 1,156,597 | 10/1915 | Hanson | 254/77 X |
| 2,362,707 | 11/1944 | Malmquist | 81/381 X |
| 2,608,793 | 9/1952 | Gant | 254/77 |
| 2,627,769 | 2/1953 | Anderson et al. | 81/383 X |
| 4,114,433 | 9/1978 | Bowen | 73/143 |

*Primary Examiner*—James G. Smith
*Attorney, Agent, or Firm*—Fleit & Jacobson

[57] ABSTRACT

A clamping device for stretching sheet material, such as a canvas painting, about a frame member is disclosed. The apparatus of the invention comprises a hand-held clamping device which includes a pair of pivotally connected jaw-carrying members that are movable from an open position, in which the opposing jaws are spaced apart from each other, to a clamping position in which the opposing jaws are placed in tight engagement with each side of the canvas or like sheet material. The first jaw carrying member comprises an elongated handle-type structure or arm that is pivotally connected with the second jaw-carrying member. The latter comprising a plate-like structure having two parallel sides which form a groove for receiving the first jaw-carrying member. A locking mechansim is slidably mounted within the second jaw-carrying member in a manner such that when the device is in a canvas-holding position, one end of the locking bolt presses against a shoulder formed on the first jaw-carrying member and imparts a clockwise locking motion to the jaw formed on the first jaw-carrying member. Thus, the upper jaw is pressed tightly and locked against the opposing jaw, the latter serving to increase and maintain the gripping force between the upper and lower jaws. A particularly advantageous concept of the invention involved the use of a pre-set tension spring which serves as a primary functional component of a tension gage mounted on the device so that the tension or pressure exerted on the sheet material can be readily determined.

13 Claims, 19 Drawing Figures

CANVAS
46
8
21
20
4
43
44
42
40
15
41
1
2
5
3
48
45
30
37
66
34
39
31
33
36
38
6
2a
17
50
47
32
11

10
14
35
13

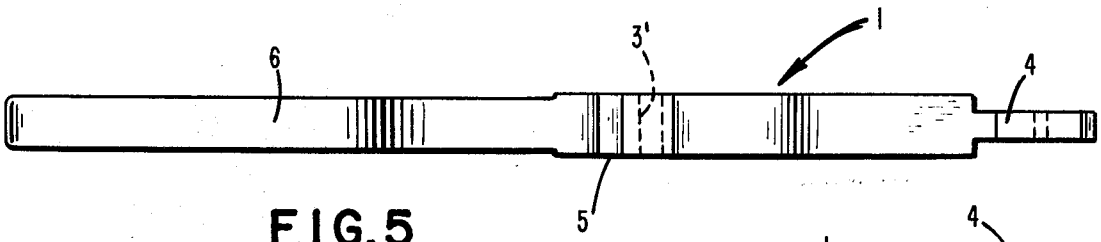
FIG.5
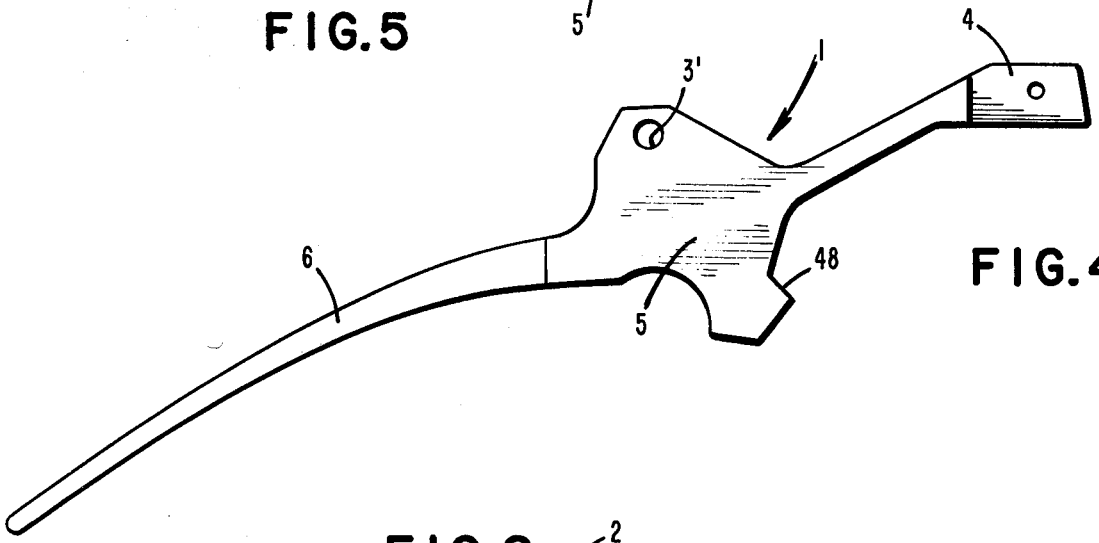
FIG.4
FIG.8
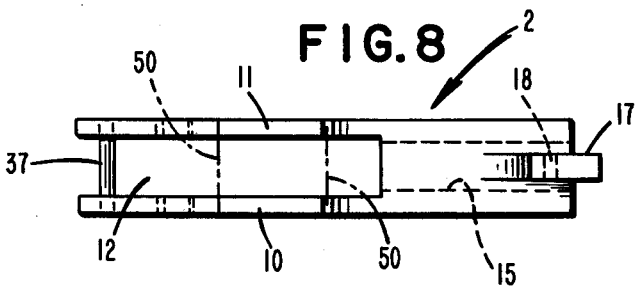
FIG.7
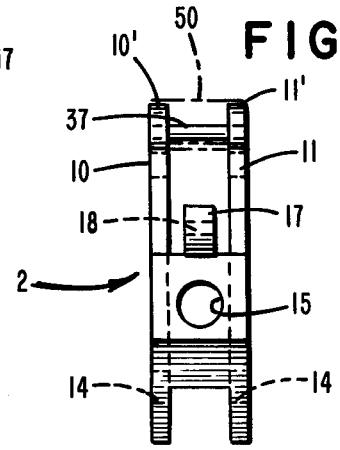
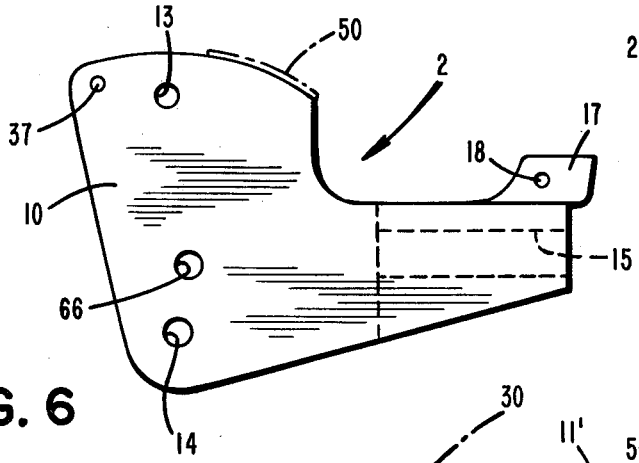
FIG. 6
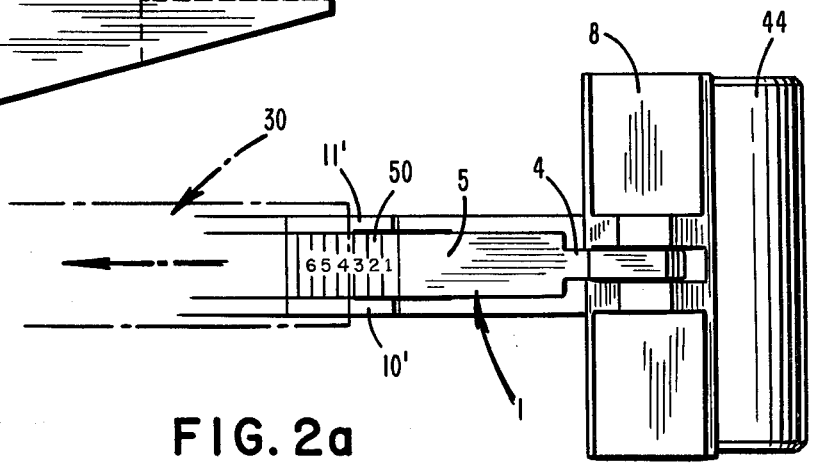
FIG. 2a

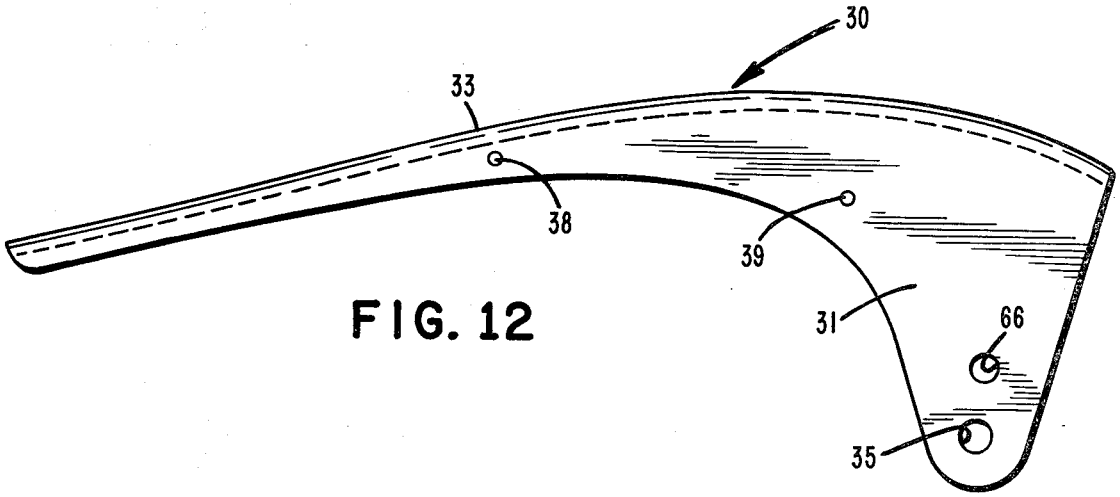
FIG. 12
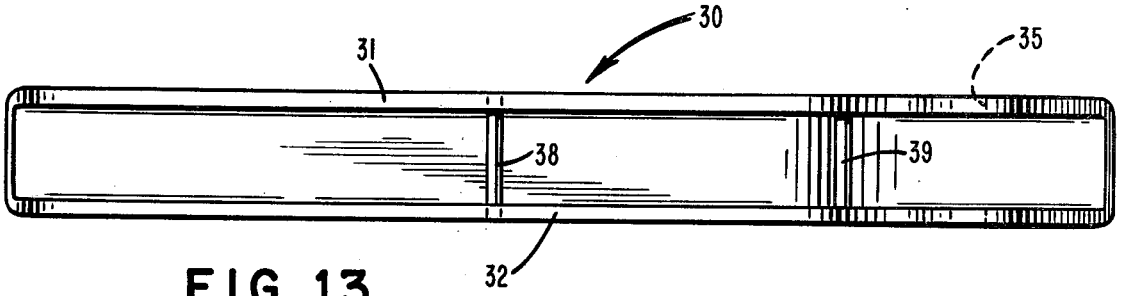
FIG. 13
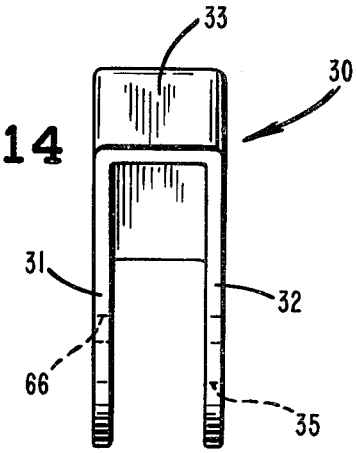
FIG. 14
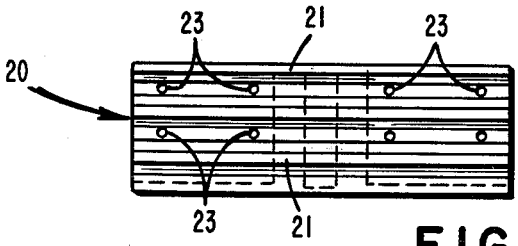
FIG. 11
FIG. 9
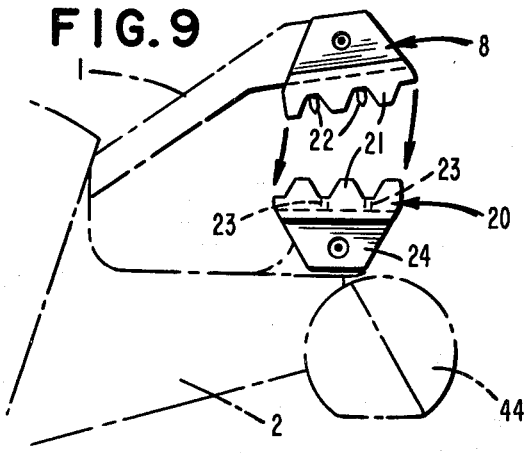
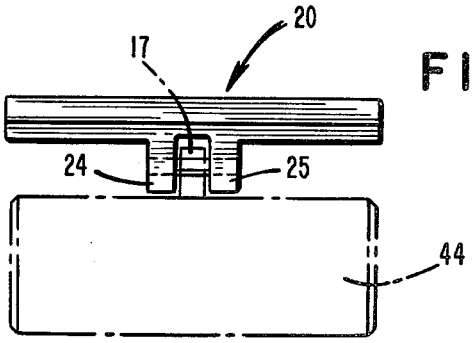
FIG. 10

CANVAS
44
52
4
1
65
5
30
37
36
64
62
60
61
2
3
34
66
6b
6c
6a
46
54
55
56
57
58
53

HAND-HELD CANVAS STRETCHING APPARATUS

BACKGROUND OF THE INVENTION

1. Field of the Invention

The present invention relates to a clamping device for stretching sheet material and, more particularly, to a unique hand-held clamping device for stretching canvas paintings over the outer edges of a frame member.

2. Description of the Prior Art

As is well known in the art, canvas paintings are conventionally mounted on frames, the latter typically comprising a wooden frame fastened together at the four corners with braces. In general, the canvas is stretched over the outer edges of the frame and is secured thereto by known means such as with staples or nails. In accordance with this basic technique, a portion of the canvas is stapled to the edge of the frame. The canvas is then draped over the opposite side of the frame and manually stretched about the frame. In accordance with this standard procedure, the canvas is stretched over the frame by a manual clamping device held in the hand, typically known in the art as canvas stretching pliers. Such known canvas stretching devices are very similar in design to conventional pliers, and include, e.g., elongated arms or handles that are pivotally connected intermediate of the arms and which further include at the forward end of each arm, a pair of opposing jaw members having interlocking grooves or teeth. While such means are similar in design to conventional pliers, the interlocking jaws are generally relatively wide in width, i.e., transversely of the arms, so that they may firmly grasp the canvas without the danger of tearing it. A specific example of such a structure is disclosed in U.S. Pat. No. 148,347 which issued to J. A. Boler on Mar. 10, 1874.

While canvas stretching pliers are well known and are presently the only known means used for stretching canvas paintings, including very expensive works of art and/or masterpieces, they suffer from a number of serious disadvantages. In this regard, in stretching a canvas over a frame it is very important that the tension placed on the canvas be closely controlled and be maintained substantially uniform in all directions. In other words, the tension along the top and bottom of the frame should be equal to that on each side, otherwise it will warp. While the required tension may vary widely between paintings, for a given painting the tension must be equal in all directions. However, with known stretching pliers, such as noted hereinabove, the amount of tension placed on the canvas when stretching it about the frame can only be estimated.

Furthermore, this operation requires a significant amount of tension to maintain the canvas in a taut condition over the frame. In using known canvas stretching pliers, this requires a tremendous amount of strength in the hands of the stretcher who must not only grip the handle of the pliers very tightly to maintain the canvas firmly grasped within the teeth of the pliers, but who also must, at the same time, cause the required leverage to be exerted on the pliers so that the required tension is achieved. Obviously such an operation can only be carried out by one highly experienced in the art. Furthermore, even if one is very experienced in this art, the use of conventional canvas stretching pliers involves a very difficult and time-consuming operation, and is an art rather than a science, from the standpoint that the exact pressure or tension placed on the canvas is, at best, only an estimate. Thus, such known devices present significant problems, particularly when dealing with valuable works of art or masterpieces. From the above, it will be seen that there is, in fact, no satisfactory tool or device available for stretching canvas about a frame. The present invention provides a truly remarkable solution to this problem.

SUMMARY OF THE INVENTION

In summary, the present invention is directed to a novel clamping device for stretching a canvas painting about a frame member. In its broadest aspect, the invention embodies the concept and relates to a hand-held clamping device which includes a pair of pivotally connected jaw-carrying members that are movable from an open position, in which the opposing jaws are spaced apart from each other, to a canvas clamping position in which the opposing jaws are placed in tight engagement with each side of the canvas. The first jaw carrying member comprises an elongated handle-type structure or arm that is pivotally connected with the second jaw-carrying member by means of a pivot pin. The latter comprising a plate-like structure having two parallel sides which form a groove for receiving the first jaw-carrying member. A locking bolt is slidably mounted within the second jaw-carrying member in a manner such that when the device is in a canvas-holding position, one end of the locking bolt presses against a shoulder formed on the first jaw-carrying member and imparts a clockwise locking motion to the jaw formed on the first jaw-carrying member. Thus, the upper jaw is pressed tightly and locked against the opposing jaw, the latter serving to increase and maintain the gripping force between the upper and lower jaws. In other words, the clamping force or pressure between the upper and lower jaws becomes greater as the canvas is stretched toward its desired tension.

In the practice of the invention, an elongated main handle member is pivotally connected to the second jaw-carrying member by way of a pre-set tension spring. As to be described in detail hereinbelow, the spring serves as a primary functional component for a tension gage for determining the amount of tension placed on the canvas at any one point in time. In the operation of the unique clamping device of the invention, the opposing jaw members are caused to engage the canvas and the forward end of the locking bolt is placed against a solid stationary piece, i.e., the frame. The device of the invention is then used as a fulcrum in a manner such that when the primary handle is moved in a downward arc, tension is placed on the canvas. The primary handle is moved in this downward arc until the desired tension is reached as read on the gage.

From the above it will be seen that the present invention provides a unique clamping device for stretching sheet material which not only provides means for maintaining the opposing jaws into tightly engaging relationship, but further provides means for determining the amount of tension being placed on the canvas.

It is accordingly a general object of the present invention to provide a novel clamping device for stretching a canvas, or other sheet material, about a member to which the canvas is to be secured.

A further object is to provide a hand-held structural clamping tool having self-locking means which cause the canvas to be firmly gripped by the opposing clamping surfaces without the necessity of the operator exerting a clamping pressure with his hands.

Yet another object is to provide a clamping tool having a gage for measuring the tension of the canvas being stretched.

Yet still a further object is to provide a clamping device which may be easily used by the operator thereof, and which does not require the above average physical strength of known canvas stretching devices.

Yet still another object is to provide an improved clamping device which is simple in design and construction and which is reliable in operation and economical to manufacture.

BRIEF DESCRIPTION OF THE DRAWINGS

The manner in which the foregoing and further objects are achieved in accordance with the present invention will be better understood in view of the following detail description and accompanying drawings and wherein:

FIG. 2*a* is a partial top plan of the apparatus embodiment illustrated in FIG. 2 as viewed along 2*a*—2*a* of FIG. 2.

FIG. 4 is a side elevation illustrating a preferred form of the first jaw-carrying member that forms a part of the clamping device of the present invention.

FIG. 5 is a top plan view of the component part shown in FIG. 4.

FIG. 6 is a side elevation illustrating a preferred form of the second jaw-carrying member that forms a component part of the apparatus of the invention.

FIG. 7 is a front end view of the component part shown in FIG. 6.

FIG. 8 is a top plan view of the component part shown in FIG. 6.

FIG. 9 is a side elevation illustrating the jaw members of the apparatus of FIGS. 1 and 2 as shown in an open position, with associated elements being shown in phantom lines.

FIG. 10 is a front elevation of the lower jaw member shown in FIG. 9.

FIG. 11 is a top plan view of the lower jaw member.

FIG. 12 is a side elevation of a preferred form of the primary handle member used in the apparatus of the invention.

FIG. 13 is a bottom plan of the component part shown in FIG. 12.

FIG. 14 is a front end view of the primary handle member shown in FIG. 12.

DETAILED DESCRIPTION OF PREFERRED EMBODIMENT(S)

Figures 1, 2, 3:
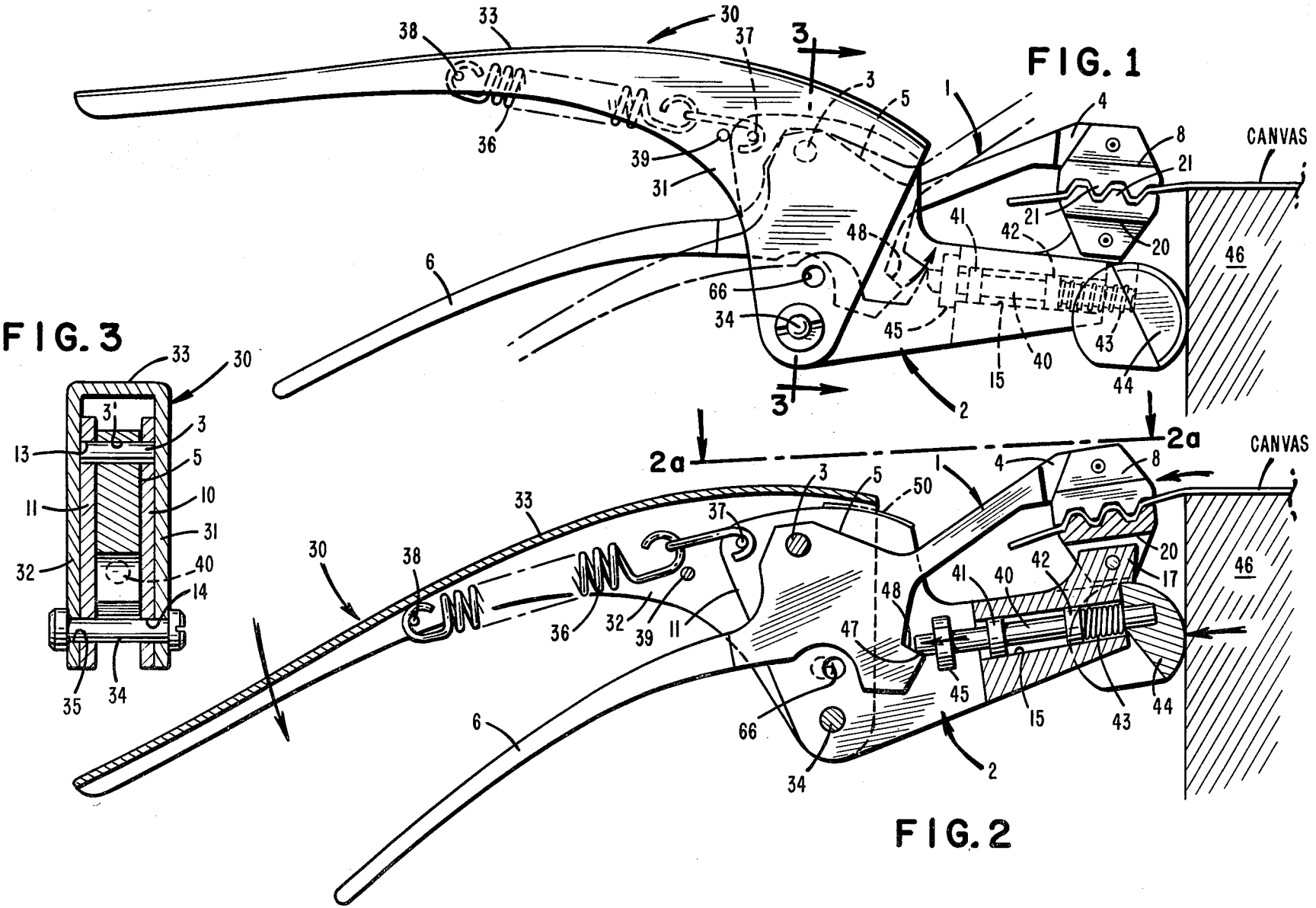
FIG. 1 is a side elevation showing a particularly advantageous apparatus embodiment of the invention.
FIG. 2 is a side elevation, in partial section, similar to FIG. 1, except that the clamping device of the invention is shown being swung in a downward arc.
FIG. 3 is a cross-section taken along line 3—3 of FIG. 1.

As briefly noted above, the present invention relates to a unique clamping device for stretching a canvas, or like material, about the periphery of a frame. Broadly speaking for the moment, the novel apparatus of the invention comprises first and second opposing jaw-carrying members which are interconnected by means of a pivot pin. The first jaw-carrying member comprises an elongated structure having a first end, intermediate and a second end portion. A clamping member or jaw is pivotally secured to the first end of the first jaw-carrying member with the opposite end thereof comprising a handle for moving the jaw into an open and closed position. The second jaw-carrying member comprises a plate-like structure having first and second ends and which includes two parallel sides that define a groove for receiving the intermediate portion of the first jaw-carrying member. A horizontal channel or cavity is formed in the first end of the second jaw-carrying member for receiving an elongated locking bolt that is slidably mounted therein. A primary handle member is pivotally mounted to the second jaw-carrying member. In operation, when the opposing jaw members are moved to a closed canvas-holding position, and the forward end of the locking bolt is placed against the side of the frame, the device serves as a fulcrum when the handle is moved in a downward arc and imposes tension on the canvas so that the canvas can be permanently secured, i.e., as by tacking, to the frame. A preset tension spring, having one end secured to the second jaw-carrying member, serves as the primary functional component of a tension gage mounted on the device, so that the tension or pressure exerted on the canvas can be readily determined. As will be seen from the following detailed description, with reference to the drawings, the apparatus of the invention is simple in design, very reliable in its operation, and provides a long-felt need in the art of stretching canvas paintings.

Turning now to the drawings in detail, and first to FIGS. 1–8, there is shown a particularly advantageous and preferred apparatus embodiment of the invention that comprises first and second jaw-carrying members 1 and 2 that are pivotally connected by way of a pivot pin 3. As best shown in FIGS. 4 and 5, the first jaw-carrying member includes, and is defined by, a first jaw carrying portion 4, an intermediate portion 5, and a second or handle portion 6. In the embodiment illustrated in FIGS. 4 and 5, the first jaw-carrying member is an elongated integral one-piece structure which is adapted to carry and includes, at its forward end 4, a pivotally mounted substantially rectangularly shaped upper jaw member 8.

The second jaw-carrying member 2 comprises an integral plate-like member having two parallel side walls 10 and 11 that extend upwardly and define an opening 12 for receiving the intermediate portion 5 of the jaw-carrying member 1. A small aperture 13 is formed in the upper portion of the side walls 10 and 11 for receiving the pivot pin 3 which, as shown in FIG. 3, extends through the aperture 3' formed in the intermediate portion of the element 1. The forward end of the lower jaw-carrying member 2 includes a horizontal cavity or channel 15 for receiving a locking bolt or member 40, the latter being shown, e.g., in FIGS. 1 and 2. As shown in FIG. 6, channel 15 extends from the forward end of the component 2 through the opening 12 formed by the side walls 10 and 11. A small shoulder portion 17 is also formed integral with the plate-like member 2 in the manner as shown at FIG. 6 and includes a small aperture 18 for pivotally securing or mounting the lower jaw member 20.

In this regard, in the embodiments illustrated in FIGS. 1–2, the upper and lower jaws, 8 and 20 respectively, comprise substantially rectangularly shaped elements having interlocking teeth 21 that extend longitudinally along the inner and opposed surfaces of the respective jaw members 8 and 20 and transversely of the upper and lower jaw-carrying members 1 and 2. As best seen in FIGS. 9 and 11, a plurality of prongs or nail-like projections 22 are positioned within the recesses formed between the longitudinally extending teeth of the jaw 8 which serve to forceably hold the canvas when the opposed jaw members are moved to a canvas-holding position such as shown in FIGS. 1 and 2. Small cutout portions or apertures 23, formed on the opposed surface of the jaw 20, are adapted to receive and mate with the corresponding nail-like projections 22. It should, of course, be understood that the concept here resides in the use of the projections and mating openings and not in their particular location, the number of projections, etc. Parallel side walls or shoulders, indicated as at 24 and 25 in FIG. 10, are formed integrally with the outer surface of the jaw 20 for pivotally mounting the jaw to the lower jaw-carrying member 2, with the opposing jaw element 8 being of an identical design and structure.

With reference now to FIGS. 12–14, in accordance with the present invention the primary handle member, indicated at 30, is defined by and comprises a substantially inverted U-shaped configuration that includes parallel side walls 31 and 32 connected by way of an arcuate web or upper wall portion 33. As best shown in FIGS. 1–3, the primary handle member 30 is pivotally secured to the lower jaw-carrying member 2 by way of a pivot pin 34 that extends through and is carried by the aperture 35 formed in the forward end of the primary handle member 30 and the mating aperture 14 formed in the lower jaw-carrying member 2. FIG. 3, which is a cross-sectional view along lines 3—3 of FIG. 1, clearly illustrates the structural assembly of the upper and lower jaw-carrying members 1 and 2 in relation to the primary handle 30.

In this regard, and with reference again to FIGS. 1 and 2, a high-tensioned coiled spring 36 is secured to the lower jaw-carrying member 2 by way of a pin 37 with the opposite end of the spring being disposed within the handle 30 as shown, and being secured thereto by means of a pin 38. In the operation of the unique clamping device of the invention, the opposing jaw members 8 and 20 are caused to be moved into an open position (as shown in FIG. 9) by merely pressing downwardly on the handle 6 of the upper jaw-carrying member 1. This causes the upper jaw 8 to be pivoted upwardly. The jaws are then moved in a position to engage the canvas, i.e., into a canvas-holding position, by causing the handle to be moved upwardly and by moving the primary handle member 30 in a downward arc.

As briefly noted hereinabove, a particularly unique feature of the present invention involves the use of a locking mechanism that is slidably mounted within the horizontal channel 15 formed in the lower jaw-carrying member 2 and which serves as a self-locking means which causes the canvas to be firmly gripped and self-locked by the opposing surfaces of the jaws without the necessity of the operator exerting a clamping pressure with his hands. As shown in FIGS. 1 and 2, the locking bolt 40 is slidably mounted and positioned contrally within the channel 15 by way of the spacers or washers 41 and 42. A spring 43 serves to maintain the bolt or locking mechanism in a normally forward position. The forward end of the locking mechanism comprises an elongated cylindrical element 44 which is truncated in the manner as shown, e.g., in FIGS. 1 and 2 and which is mounted on and/or formed integrally with the locking bolt 40 such that it is perpendicular therewith. That is, the truncated cylindrically-shaped element 44 is perpendicular to the locking bolt 40. A small stop or washer 45 serves to prevent movement of a locking bolt 40 forward of its position shown in FIG. 1, and thus limits its forward movement and secures same within the channel 15. In the practice of the invention, the jaws 8 and 20 are caused to be moved to a canvas-holding position with the forward end 44 of the locking mechanism then being pressed against the frame 46 about which the canvas is to be stretched. This position is that as shown in FIG. 1. As the element 44 is pressed against the frame 46, the locking bolt is caused to be moved rearwardly and in the direction of the arrow of FIG. 2 such that the camed surface 47 of the locking bolt is caused to press against the shoulder 48 formed on the intermediate portion 5 of the first jaw-carrying member 1. See FIGS. 1–2. This action causes the upper jaw-carrying member 1 to be rotated, or pivoted, about the pin 3 in a clockwise fashion so that the upper jaw 8 presses tightly against the canvas and in a self-locking relationship with the opposed jaw 20. In other words, the upper jaw member is locked in place by pressing the forward end 44 of the locking mechanism against the frame 46. The primary handle member 30 is then used as a fulcrum such that when the primary handle is moved in a downward arc, tension is placed on the canvas until the canvas can be tacked or secured to the frame 46.

As also briefly noted above, a further particularly unique, advantageous and very significant feature of the present invention resides in the use of the pre-set tension spring 36 as a primary functional component for determining the amount of the tension placed on the canvas at any one point in time. In this regard, and with reference to FIG. 2*a*, in accordance with the present invention there is provided indicia means which is secured to the upper surfaces 10' and 11' of the parallel side walls 10 and 11 of the lower jaw-carrying member 2. When the clamping device of the invention is initially placed in the canvas-holding position as shown in FIG. 1, the primary handle member 30 is in a forward position with any further forward movement being prevented by a small rod or stop means 39 secured to, and positioned between, the side walls 31 and 32 of the primary handle member 30. Note FIG. 13. At this point, the pre-set tension spring 36 is substantially closed and maintains the primary handle member 30 in a substantially horizontal position. As the handle 30 is caused to be moved in a downward arc, as shown, for example, in FIG. 2, the handle 30 pivots counter-clockwise thus exposing the upper surface of the indicia means 50. In this manner, the tension on the canvas may be determined by merely noting that point (or reference numeral) on the indicia means when the required tension is reached. As previously noted, in stretching a canvas about a frame, it is indeed significant and critical that the canvas is stretched in a manner such that the tension on all four sides of the frame is equal. Prior to the present invention, this could only be approximated and then only by one skilled in the art of stretching canvas. Thus, after the first side of the canvas is secured to the frame, the operator would stretch the canvas on the second or opposite side to a tension equal to that of the first side with a corresponding procedure being followed for the third and fourth sides of the frame.

In the practice of the invention, one manner of determining the actual tension placed on the canvas would involve selecting a number of pre-set tension springs, each being of a known value, and then by trial and error determining, for a particular canvas, the particular spring that would pull the canvas taunt just prior to the handle member 30 being pivoted to expose the indicia means 50. The indicia means may then be marked accordingly if desired. It has been found that a 30 pound pre-set tension spring is particularly suitable for use with conventional medium weight canvas typically used for oil paintings. In manufacturing the unique clamping device of the invention, a number of springs may be provided with the basic instrument so that the user thereof may simply employ the required spring for a given canvas. However, the use of a number of springs, as aforesaid, is not necessary if exact tension measurements are not desired.

Figures 15, 16, 17A, 17B:
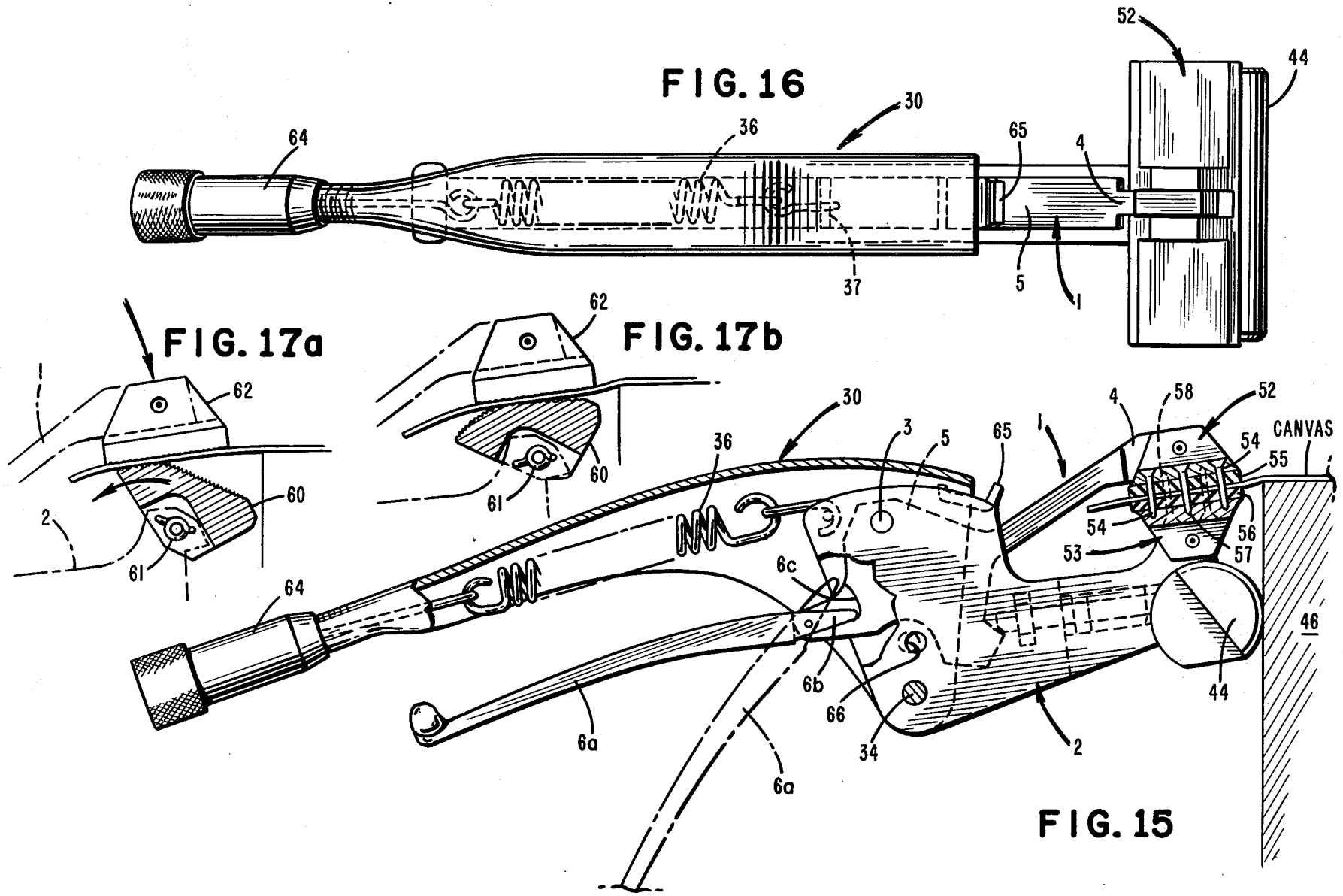
FIG. 15 is a side elevation, in partial section, of a further apparatus embodiment of the present invention.
FIG. 16 is a top plan view of the apparatus embodiment shown in FIG. 15.
FIG. 17*a* is a side elevation, in partial section, illustrating a further embodiment of the upper and lower jaw members employed in the apparatus of the invention and showing the jaws in a partially open position.
FIG. 17*b* is a side elevation, in partial section, and similar to FIG. 17*a* except showing the upper and lower jaws in a closed, canvas-holding position.

While the design of the jaw members 8 and 20 are particularly suitable for use in combination with the clamping device of the invention, it should, of course, be recognized that additional designs or structures may be employed. Thus in FIGS. 15, 17*a* and 17*b* further particularly advantageous apparatus embodiments in connection with the design of jaw members are shown. With reference to FIG. 15, the upper and lower jaws, indicated generally at 52 and 53, respectively, include a series of alternating nail-like projections 54 which, as shown, extend through resilient pads or discs 55 and 56 secured to the inner surfaces of each jaw. The projections are also further adapted to fit within mating apertures or openings 57 and 58 formed in the opposing resilient pad and the jaw itself. The resilient members 55 and 56, which may be formed of natural or synthetic rubbers, foamed plastic materials such as polystyrene, polyurethane and the like, etc., serve to firmly grip the canvas and prevent any movement or slippage thereof. FIGS. 17*a* and 17*b* illustrate a still further embodiment of the jaw members. In accordance with this structure, the lower jaw 60 is in operable association with a coiled spring 61 which urges the jaw in a normally forward position as shown in FIG. 17*a*. As the jaws are placed about the canvas and into a canvas-holding position, the upper jaw 62 forces the lower jaw 60 to a rearward position as shown by the arrow in FIG. 17*a*. This is in opposition to the force applied by the spring 61. Thus when the jaws 60 and 62 are in a canvas-holding position (as shown in FIG. 17*b*), the canvas is tightly clamped by the opposing forces created by the spring 61 and the downward force of the primary handle member 30.

In accordance with the further apparatus embodiment of the invention, the pre-set tension spring 36 is secured to a screw-adjustment mechanism, indicated at 64, which is threadably connected to the primary handle member 30 as shown, e.g., in FIGS. 15 and 16. In accordance with this embodiment, it is possible to employ a single pre-set tension spring for different weight canvases by merely adjusting the tension of the spring by way of the screw adjustment mechanism 64. Further modifications of apparatus embodiments shown in FIGS. 15 and 16 include the use of a bifurcated handle member 6*a*, which as shown in FIG. 15, permits the handle 6*a* to be moved downwardly and out of the way as the primary handle member 30 is pivoted in a downward arc. As shown, the bifurcated handle member 6*a* is pivotally mounted with its forward end 6*b* being mounted within a cut out portion or notch 6*c*, the latter serving to prevent the handle 6*a* from being moved upwardly relative to the upper jaw-carrying member 1.

A further modification of the embodiment of FIG. 15 comprises a L-shaped stop member 65 which serves to prevent the forward movement of the primary handle member 30 in a manner similar to that of the stop mechanism 39 shown, e.g., in FIG. 2.

While various apparatus embodiments have been discussed hereinabove, it should be expressly understood that such embodiments have been disclosed for illustrative purposes only and are not intended to limit the invention thereto. In this regard, while the clamping device of the invention has been disclosed as having particular utility for use in stretching canvas, it should be readily appreciated by those skilled in the art that the device may be used for stretching many forms of sheet materials, such as silk screens. In this regard, and as an example of further embodiments of the present invention, a small aperture 66 may extend through and between the primary handle member 30 and the lower jaw-carrying member 2, as shown in FIG. 15, for the receipt of a small pin or rod, the latter serving to prevent relative movement between the said lower jaw-carrying member and the primary handle member. In this embodiment, a small rod would be simply slipped into the aperture 66. Such action, which negating the use of the tension gage, would render the apparatus suitable for use in applications other than in stretching canvas.

What is claimed is:

1. A clamping device for stretching a canvas about a frame member comprising in combination; first and second opposing jaw-carrying members connected by means of a pivot pin; said first jaw-carrying member comprising an elongated arm having first, intermediate and second end portions and having an upper jaw pivotally secured to said first end portion thereof; said second jaw carrying member comprising a plate-like structure having first and second ends and having two parallel side walls formed on said second end thereof which define a groove for receiving the intermediate portion of said first jaw-carrying member; and having a lower jaw pivotally mounted to said first end thereof; a primary handle member mounted to said second jaw-carrying member; a locking mechanism slidably mounted within an aperture formed in said first end of said second jaw-carrying member, said locking mechanism, when placed in contact with the frame about which the canvas is to be stretched, being caused to be forced inwardly and to press against a shoulder formed on said intermediate portion of said first jaw-carrying member whereby upon a downward swinging motion of said primary handle member, the jaw secured to said first jaw-carrying member is caused to be rotated clockwise and into a tightly clamping and locked relationship with the opposing jaw formed on said second jaw-carrying member.

2. The apparatus in accordance with claim 1 and further comprising a pre-set tension spring having one end secured to said lower jaw-carrying member and having its opposite end secured to said primary handle member, said spring serving as a primary functional component for determining the amount of tension placed on the canvas at any one point in time.

3. The apparatus in accordance with claim 2 and further comprising indicia means secured to said second jaw-carrying member whereby, when said primary handle member is moved in a downward arc, said indicia means provides a direct measurement of the tension on said canvas.

4. The apparatus in accordance with claim 1 and further comprising a plurality of nail-like projections formed integrally with the clamping surface of at least one of said jaws, the opposing jaw having mating recesses adapted to receive said projections.

5. The apparatus in accordance with claim 1 wherein the opposed inner surfaces of said upper and lower jaws are each provided with a plurality of nail-like projections adapted to extend through said canvas when said jaws are in a canvas-holding position and further comprising resilient means formed on said inner surfaces, said nail-like projections extending through said resilient means, each of said jaws also having apertures formed on the opposed jaw for receiving said projections.

6. The apparatus in accordance with claim 1 wherein one of said jaws includes a spring in operable association therewith, whereby when said jaws are moved into a canvas-holding position, said spring serves to maintain the opposed surfaces of said upper and lower jaws in a tightly clamped, self-locking relationship.

7. The apparatus in accordance with claim 1 and further comprising means, in operable association with said second jaw-carrying member and said primary handle member, for preventing rotation or movement of said jaw-carrying member and said handle relative to each other.

8. The apparatus in accordance with claim 1 and further comprising a spring in operable association with said second jaw-carrying member and said primary handle means; a tension gauge comprising indicia means secured to said jaw-carrying member and serving, when said primary handle member is moved in a downward arc, to provide a reading of the tension placed on the canvas when said primary handle means is moved in a downward arc.

9. A clamping device for stretching a canvas about a frame member comprising in combination; first and second jaw-carrying members; said first jaw-carrying member comprising an elongated arm having first, intermediate and second end portions; said second jaw carrying member having means which define a groove for pivotally mounting said intermediate portion of said first jaw-carrying member therein; a primary handle member pivotally mounted to said second jaw-carrying member; a locking mechanism slidably mounted within a channel formed in second jaw-carrying member, said locking mechanism, when placed in contact with the frame about which the canvas is to be stretched, being caused to be forced inwardly and to press against said first jaw-carrying member whereby upon a downward swinging motion of said primary handle member, the jaw secured to said first jaw-carrying member is caused to be rotated clockwise and into a tightly clamping and locked relationship with the opposing jaw formed on said second jaw-carrying member; said device further comprising a pre-set tension spring having one end secured to said second jaw-carrying member and having its opposite end secured to said primary handle member; indicia means secured to said second jaw-carrying member whereby, when said primary handle member is moved in a downward arc, said indicia means provides a direct measurement of the tension on said canvas.

10. The apparatus in accordance with claim 9 wherein the opposed inner surfaces of said upper and lower jaws are each provided with a plurality of nail-like projections adapted to extend through said canvas when said jaws are in a canvas-holding position and further comprising resilient means formed on said inner surfaces, said nail-like projections extending through said resilient means, each of said jaws also having apertures formed on the opposed jaw for receiving said projections.

11. The apparatus in accordance with claim 9 wherein one of said jaws includes means in operable association therewith, which urges said jaw forwardly whereby, when said jaws are moved into a canvas-holding position, said means serves to maintain the opposed surfaces of said upper and lower jaws in a tightly clamped, self-locking relationship.

12. The apparatus in accordance with claim 9 wherein said locking mechanism further comprises a first arm slidably mounted within said channel formed in said second jaw-carrying member; a second arm formed perpendicular with said first arm and adapted to be placed in contact with the frame about which the canvas is to be stretched; resilient means positioned with said channel for maintaining said locking mechanism in a normally forward position and stop means secured to said first arm for restricting said forward movement.

13. The apparatus in accordance with claim 12 and further comprising means threadably connected to said primary handle for adjusting the tension of said pre-set tension spring.

* * * * *